US005740630A

United States Patent [19]

Medebach

[11] Patent Number: 5,740,630

[45] Date of Patent: Apr. 21, 1998

[54] CABLE-DRIVEN WINDOW LIFT

[75] Inventor: Thomas Medebach, Wetzlar-Dudenhofen, Germany

[73] Assignee: Kuster & Co. GmbH, Germany

[21] Appl. No.: 553,538

[22] PCT Filed: Mar. 30, 1995

[86] PCT No.: PCT/EP95/01196

§ 371 Date: Jan. 24, 1996

§ 102(e) Date: Jan. 24, 1996

[87] PCT Pub. No.: WO95/27116

PCT Pub. Date: Oct. 12, 1995

[30] Foreign Application Priority Data

Mar. 30, 1994 [DE] Germany ..... 44 11 194.0

[51] Int. Cl.[6] ..... E05F 11/48

[52] U.S. Cl. ..... 49/352

[58] Field of Search ..... 49/352, 227

[56] References Cited

U.S. PATENT DOCUMENTS

| | | | |
|---|---|---|---|
| 4,442,632 | 4/1984 | Greco et al. | 49/352 |
| 4,657,523 | 4/1987 | Chevance et al. | 49/352 |
| 5,505,022 | 4/1996 | Shibata et al. | 40/352 |

FOREIGN PATENT DOCUMENTS

| | | |
|---|---|---|
| 3432178 | 1/1986 | Germany . |
| 3325837 | 10/1986 | Germany . |

*Primary Examiner*—Kenneth J. Dorner
*Assistant Examiner*—Jerry Redman
*Attorney, Agent, or Firm*—Longacre & White

[57] ABSTRACT

A cable window-lift in particular for motor vehicles and comprising a drive (1) for the alternating winding and unwinding of the cable (2) running in at least one loop and which cable, in relation to pane movement, is divided into a cable lifting portion (15) and a cable descending portion (16) and further is linked to a pane lifter (3) displaceable up and down along a guide (5), one spring element (9, 10) being provided in the cable lifting portion (15) and cable descending portion (16) resp. to compensate cable slack. To allow raising and lowering the pane in substantially play-free manner and to avert clattering and/or wind noise, the spring (9) in the cable lifting portion (15), which is compressed when in the pane closed position, evinces a spring force greater than the resultant of the pane weight and the frictional forces arising during pane motion and also larger than the spring force of the spring (10) in the cable descending portion (16).

10 Claims, 3 Drawing Sheets

CABLE-DRIVEN WINDOW LIFT

BACKGROUND OF THE INVENTION

1. Field of the Invention

The invention concerns a cable window-lift in particular for motor vehicles and comprising a drive for alternatingly winding and unwinding the cable running in at least one loop, the drive is divided into a cable lifting portion and a cable descending portion as regards the movement of the pane, further comprising a pane lifter displaceable up and down along a guide, one spring element and being present in the cable lifting portion and in the cable descending portion to compensate cable slackness.

2. Description of the Prior Art

Illustratively, such a cable-driven window lift is described in the German patent document A-1 33 25 837, which teaches a drive mechanism comprising a cable drum for alternatingly winding and unwinding a cable for instance held in the form of a loop. Starting from the drive with two outputs, the cable runs in each case in a cable sheath or hose to a deflection site between which, when the lift is in the assembled position, the cable runs in an essentially vertical direction parallel to a window-pane guide-rail holding a pane-lifter. The cable is linked to the lifter and as a result a corresponding lifter rotation entails alternating winding and unwinding of the cable on the drum and hence to lifting and lowering the pane. Each of the drive outputs is fitted with a compression spring resting between the drive housing and the end face of the particular cable sheath. These springs assure that any slack in the cable shall be eliminated from the overall system and accordingly the cable shall remain tensioned under all operational conditions at least in the region of the rails holding the lifter. The springs of the known window lifts are designed in such manner that their spring force is less than the force arising at the lifter and displacing the pane. Some play materializes in the known window lifts when drive rotation is reversed, and said play includes the displacement path of the springs. Before there is motion of the lifter, i.e. of the pane when there is reversal of the direction of pane displacement, first the previously relaxed spring will be compressed, while the other spring will be relaxed. However, such an arrangement is disadvantageous with respect to handling because the displacement path of the two compression springs is added to the inherent play of the drive, and consequently the pane will remain in its previous position when there is reversal of motion within an angle of rotation of 20° to 40°.

The known window lift incurs another drawback in that when substantial forces are applied to the pane, the spring in the cable lifting portion is totally compressed and the pane may drop, namely by exactly the amount of said spring displacement. This displacement may be 5 to 6 mm and suffices to produce a small gap between the pane and the seal of the door frame. Clattering and undesired wind noises may arise as a result of such displacement.

OBJECT OF THE INVENTION

In the light of the above, the object of the invention is to improve a window lift of the initially cited kind making possible the raising and lowering of the window pane in substantially play-free manner and thereby to avoid clattering and wind noise. Additionally, for vehicle window-lifts driven by electric motors providing a short descending excursion of the pane, a reversed design of the compensating springs is recommended. Such short-excursion descents are used without additional pane guide-frames; in particular, in such vehicles as coupes, the pane in its closed position is pressed against a seal mounted in the vicinity of the vehicle roof. To avert excessive mechanical stresses on the seal, the pane initially is lowered a slight amount by the motor drive during opening and closing and then is displaced in controlled manner while the door is closed into the closed position, i.e. to rest against the roof-side seal. This short stroke of the pane moves by about 10 to 15 mm. If now on account of aging the cable should be slack, then the spring mounted on the descending side of the cable must be moved totally compressed until a descent of the pane starts at all. However, because the spring mounted in the cable descending portion as set forth in this invention exerts a substantial force, this spring will not be in the totally compressed state when the pane is in the closed position. As a result, no significant spring displacement takes place during lowering, and thereby all slack is removed from the cable system.

The invention also applies to a cable window-lift with a closed cable loop, and in this case the springs are preferentially mounted at the drive outputs and rest on one side against the drive housing while acting on the other end against the end face of each sheath enclosing the cable.

The invention also may be applied to a cable window-lift wherein said cable is interrupted in the vicinity of the lifter, the cable ends so formed being individually connected to the lifter. In the latter case the springs rest against the lifter and drive the cable ends illustratively fitted with terminal nipples.

SUMMARY OF THE INVENTION

A cable window-lift, in particular for motor vehicles, comprises a drive for the alternating winding and unwinding of the cable running in at least one loop, wherein the cable, in relation to pane movement, is divided into a cable lifting portion and a cable descending portion and further is linked to a pane lifter displaceable up and down along a guide. One spring element is provided in the cable lifting portion and cable descending portion respectively to compensate for cable slack. To raise and lower the pane in a substantially play-free manner and to avert clattering and/or wind noise, the spring in the cable lifting portion, which is compressed when in the pane closed position, evinces a spring force greater than the resultant of the pane weight and the frictional forces arising during pane motion and also larger than the spring force of the spring in the cable descending portion.

Further objects, advantages and features of the present invention are elucidated in the following description of illustrative embodiments and in relation to the enclosed drawing.

All described and/or graphically shown features per se or in arbitrary pertinent combinations do form the object of the present invention, also independently of their consolidation in the claims or their inter-relations.

DETAILED DESCRIPTION OF THE INVENTION

Figure 1:
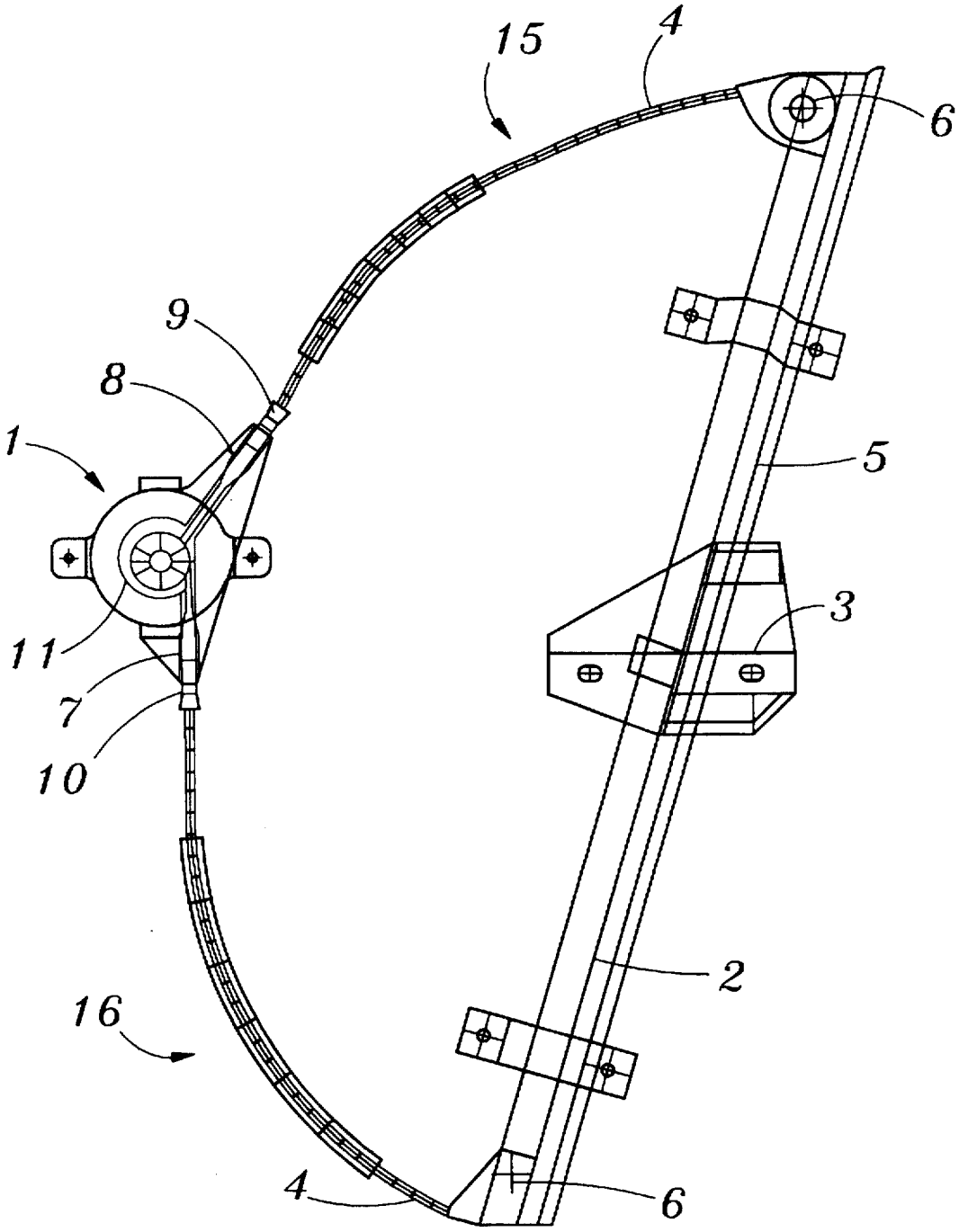
FIG. 1 is a schematic view of an illustrative embodiment of a cable window lift of the invention.

The cable window lift of FIG. 1 comprises a drive 1 with an omitted cable drum to alternatingly wind and unwind the cable 2. The cable drum is linked to an omitted crank bolt receiving a handcrank in the instance of the presently shown embodiment of a mechanical window lift. Starting at the drive 1, the cable 2 runs from two outputs 7 and 8 each time inside a cable sheath 4 to a deflection means 6 possibly in the form of a roller, whereupon the cable 2 runs parallel to a rail 5 which shall be affixed to the vehicle door. A window pane lifter 3 is present at the rail 5 and is linked to the cable 2.

A compression spring 9, 10 is present at the outputs 7, 8 of the drive 1, each spring resting between the housing 11 of the drive 1 and the end face of the particular cable sheath 4. These springs 9, 10 ensure that any slack in the cable 2 shall be removed from the overall system, whereby the cable 2 shall be tensioned under all operational conditions at least in the region of the rail 5.

The design of the springs 9, 10 in known window lifts is such that their spring force is less than the pane-moving force acting on the lifter 3. If the lifter 3 of FIG. 1 were displaced upward, i.e., if the pane were moved into the closed position, then the spring 9 affixed in the cable lifting cable portion 15 would be compressed or even possibly compressed totally together, whereas the spring in the cable descending portion 16 would be relaxed, and slack present between the output 7 and lifter 3 would be eliminated. If next the pane shall be opened by moving the lifter 3 downward, then the spring 10 present in the cable descending portion 16 shall be compressed while now the spring 9 in the lifting cable portion 15 relaxes, and any slack between the output 8 and the upper end of the lifter 3 is eliminated. In the known window lifts some play is produced when the drive 1 implements a reversal in rotation, said play furthermore including the displacement path of the compression springs 9, 10: Before the lifter 3 and hence the pane will move when there is reversal of direction of rotation, first the previously relaxed spring 9 or 10 shall be compressed, during which procedure the particular other spring 10 or 9 shall relax. This mechanism however is disadvantageous in handling the pane because this pane will remain in its previous state through an angle of rotation for instance 20° to 40°.

In order to eliminate the play caused by the compression springs 9, 10 from the overall system, the window lift of the invention calls for a spring force exerted by the compression spring 9 affixed to the upper output 8 when in the assembly position of the cable window lift which shall be larger than the force of displacement of the pane and larger than the spring force of the spring 10 affixed in the cable descending portion 16. When the lifter 3 moves downward, the spring 10 affixed in the cable descending portion 16 will be compressed totally, as in the state of the art, while the compression spring 9 affixed in the lifting cable portion 15 relaxes. Upon a subsequent upward movement of the lifter 3 however, the compression spring affixed in the lifting cable portion 15 remains in its relaxed or nearly relaxed position on account of its higher spring force, and this spring 9 practically eliminates all slackness from the system, as a result of which the lower spring 10 remains totally or nearly totally compressed. Because the spring 9 affixed in the cable lifting portion 15 is compressed not at all or only slightly toward its state of total compression, practically no play is produced when reversing the direction of motion. These conditions are maintained as long as the pane remains below its upper limit position.

Once the pane has reached the upper limit position and thereby has entered the doorframe seal while the crank should somehow be rotated further in the closing direction, then with a corresponding drive-torque, the compression spring 9 will be pressed together and may assume its totally compressed state. In such a case the spring 10 mounted in the cable descending portion 16 relaxes in order to eliminate the cable slack from system. In fact a somewhat enlarged dead-zone arises during the subsequent reversal of motion of the pane. However this dead zone is compensated by the advantage that when the pane is in its upper limit position, ie the closed position, if accidentally knocking the handcrank toward the pane descending direction, the pane will remain in its closed position until the compression spring 9 with the larger spring force has relaxed, the compression spring 10 then passing into its totally compressed mode.

If now for any reason an external force larger than that from the compression spring 9, for instance caused by potholes and the like, acts on the pane, then, as regards the known window lifters, the compression spring 9 is abruptly compressed to totality, as a result of which the pane descends by the excursion of this compression spring 9. The excursion may amount of 5 to 6 mm. This displacement is sufficient to generate a slight gap between the pane and the door-frame seal, entailing clattering and/or undesired wind noise. On the other hand, in the invention the force of spring 9 is larger than that produced by the pane and the frictional forces in the case of opposing forces caused by a rising motion and the compression spring 9 is able to elastically absorb such pane impacts, and as the force exerted on the pane decays, the prevailing force from the compression spring 9 will again move the pane into its initial position, that is in its closed position. Hence clattering and wind noise are eliminated.

In the case of an electrical window lifter, the compression spring 9 with its higher force and in the lifting cable portion 15 will act additionally as an impact damper when the pane hits the upper closed position.

Another advantage offered by such a window lift with the spring 9 in the cable lifting portion 15 than that of the spring in the cable descending portion 16 is that the torques are approximately equal for the lifting and descending motions of the pane. In known window lifts on the other hand the difference in torques between up and down pane motions is about 50%. Accordingly, the operators of manual window lifts frequently are under the impression—especially when first the pane has been lowered and then is to be raised again—that the window lift is unusually difficult to operate. Therefore the automobile industry already has required the most equal possible torques for up and down motions. Approximate equality of the two torques is created in the invention by mounting a spring 9 with a larger force in the cable lifting portion 15, whereas, during the descending motion, the spring 9 with the higher force causes increased friction by the cable 2 in its sheath 4. By using springs 9 and 10 of different spring forces, dispersion of torque caused by differential frictions between pane and door or pane seal also are made smaller.

Figure 2:
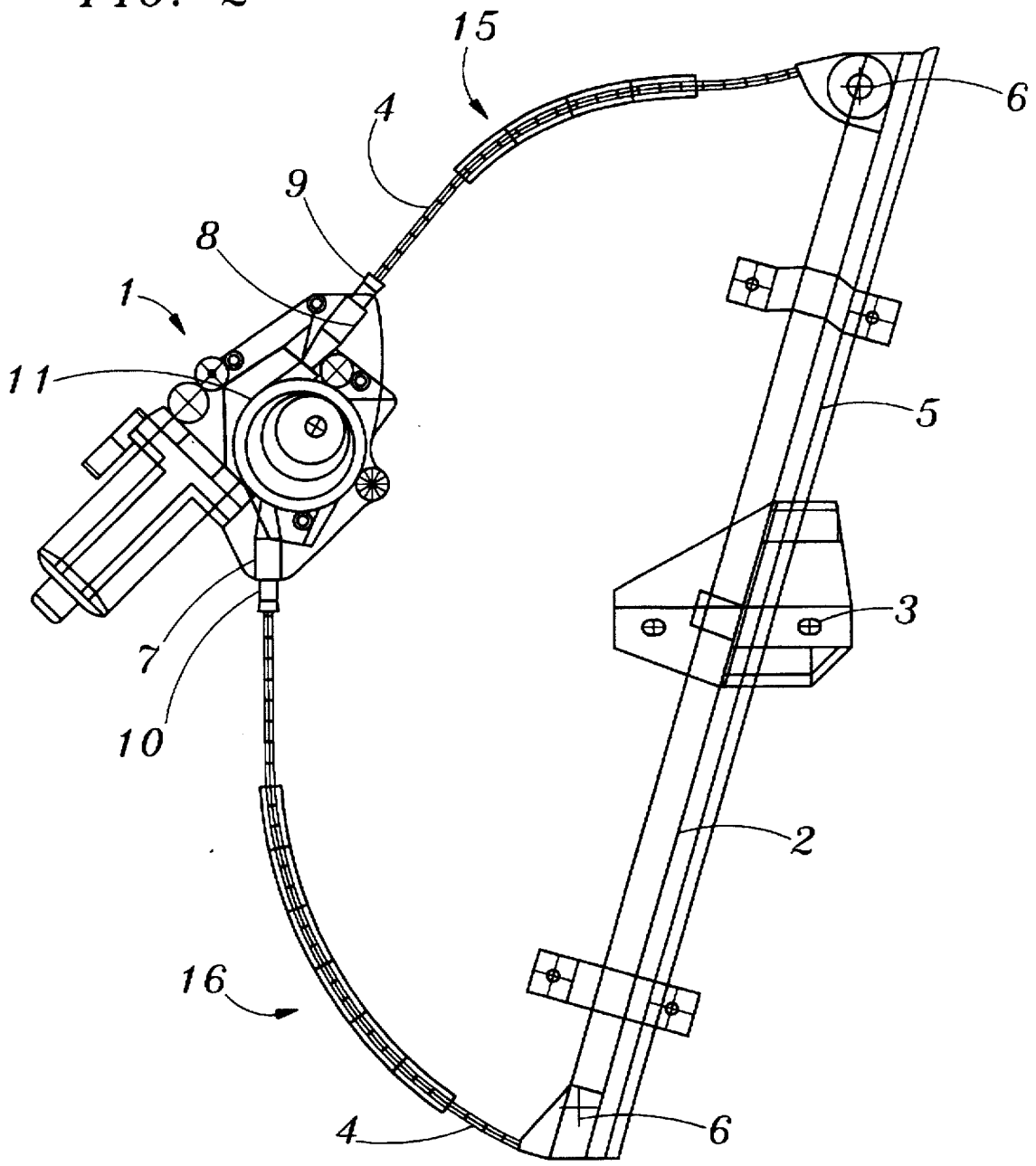
FIG. 2 is an illustrative embodiment of a cable window-lift driven by a motor.

The window lift of FIG. 2 is designed to be powered by an electric motor. The components corresponding to the embodiment of FIG. 1 are denoted by the same references and their description need not provided in detail again.

As regards the embodiment of FIG. 2, the springs 9, 10 are selected in such manner that the spring 10 in the cable descending portion 16 compressed when the pane is being opened evinces a force which is larger than the force of the pane weight and of the friction due to displacing said pane, and also larger than the lifting force from the spring 9 in the cable lifting portion 15. Such a design relating to the springs 9, 10 is especially appropriate for window lifts driven by electric motors and with short pane excursions. Such short pane excursions sometimes are used in vehicle doors lacking additional guide frames for the window pane in order to achieve improved door closing. In such vehicles lacking window guides, the pane frequently will be pressed against a seal present in the vicinity of the vehicle roof. If then the door were opened while the pane is in the closed position, the seal would be unduly stressed. Therefore the procedure has been adopted to use a switch at the door lock so that, when it is opened and closed, first the pane shall be lowered by a short path and then upon closing the door the pane shall driven in controlled manner into the closed position, that is the position in which it makes contact with the roof-side seal. The path followed by the pane during the downward short excursion is between 10 and 15 mm. If now slack is present in the cable on account of aging, then, as regards the known window lifts with the pane moving down, the spring 10 first must be totally compressed until the downward motion of the pane begins at all. However, because in the invention the spring 10 of FIG. 2 mounted in the cable descending portion 16, that is that spring mounted at the output 7, evinces a larger force, it will not be totally compressed when the pane is in the closed position. No significant spring displacement takes place when the pane descends out of the closed position, and therefore any slack is removed from the system.

It is true that in this design, that is in the selection of the springs 9 and 10, the cable friction is increased when the pane is rising, but the larger torque encountered is without significance in motor-driven window lifts that are required for instance for short-excursion panes. Another advantage of mounting the stronger spring in the cable descending portion 16 is that when the pane meets the lower limit stop, that is when it reaches its open position, impact damping is achieved, such damping being more important in electrically driven window lifts than that of the pane upward motion. Thereby as well the mechanical load on the cable will be minimized.

Figure 3:
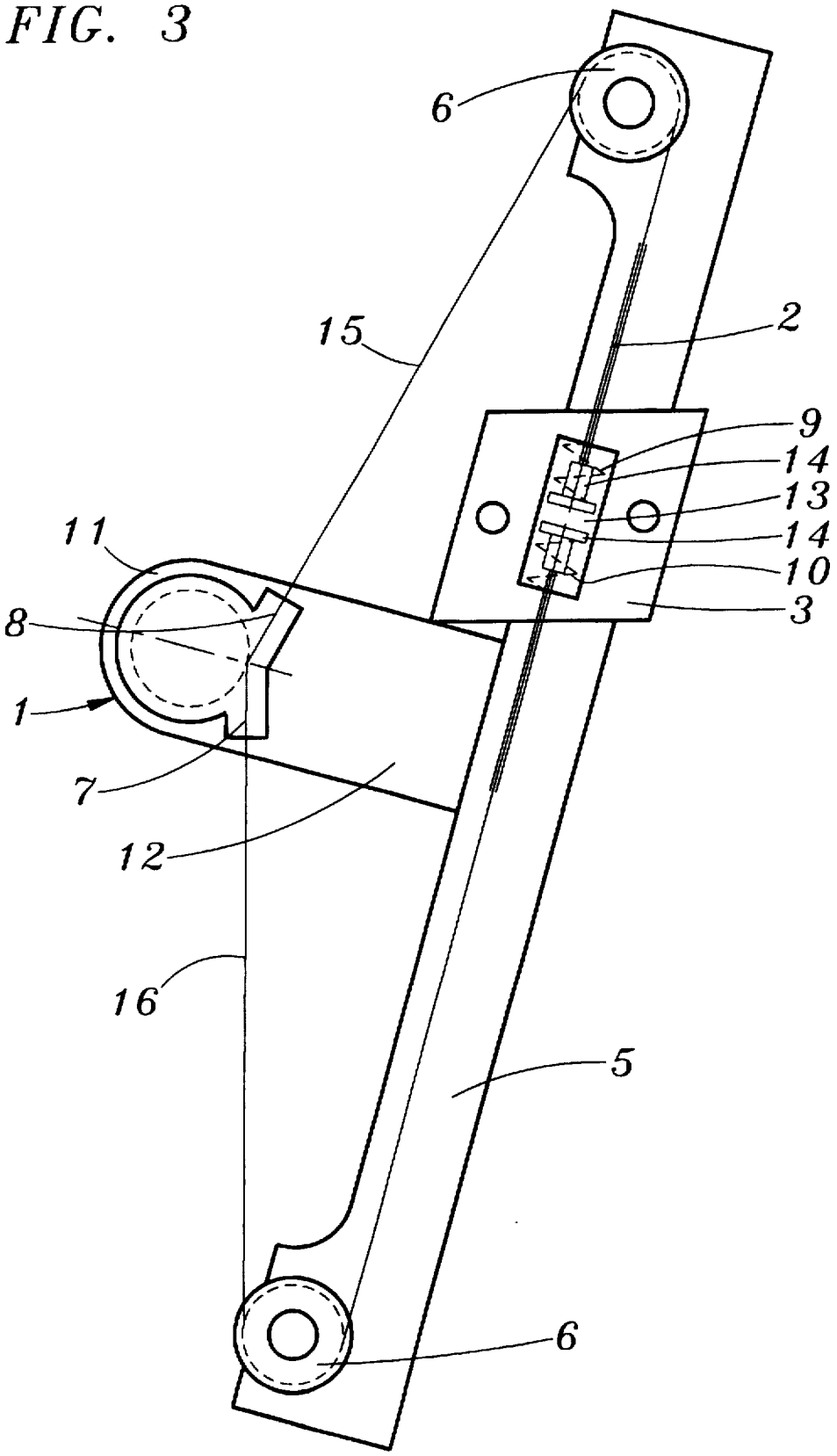
FIG. 3 is an illustrative alternative embodiment of a cable window-lift of the invention.

The embodiment of FIG. 3 concerns a window lift wherein—contrary to the embodiments of FIGS. 1 and 2—the cable 2 is interrupted in the vicinity of the lifter 3. The free ends of the cable are fitted with nipples 14 inserted into a nipple chamber 13 of the lifter 3. In this embodiment the springs 9, 10 are located inside the nipple chamber 13 to compensate any slack in the cable system, and said springs rest against the lifter 3, i.e. the wall of the nipple chamber 13 while acting by their other ends on the nipples 14 at the associated cable ends. Depending on the particular application, a larger force may be exerted by the spring 9 in the cable lifting portion 15 which is compressed in the closed pane position, or the compressed spring 10 in the cable descending portion 16 may evince the larger spring force in this embodiment just as in those described further above.

The components of FIGS. corresponding to those of FIGS. 1 and 2 also are identified by the same references and accordingly no further discussion of these identical components is required. However the embodiment FIG. 3 comprises an assembly plate or sheetmetal 12 linked to the rail 5 for ease of transportation.

I claim:

1. A cable window-lift in particular for motor vehicles and comprising a drive (1) for alternatingly winding and unwinding a cable (2) running in at least one loop and divided into a cable lifting portion (15) and a cable descending portion (16) as regards a movement of a pane, further comprising a pane lifter (3) displaceable up and down along a guide (5), a first spring element (9) being present in the cable lifting portion (15) and a second spring element (10) in the cable descending portion (16) to compensate cable slackness, wherein the first spring (9) in the cable lifting portion (15) which is compressed when the pane is being closed evinces a spring force larger than the force of displacement resulting from the pane weight and from the friction of the pane being displaced and also larger than the spring force of the second spring (10) mounted in the cable descending portion (16).

2. A cable window-lift as defined in claim 1, wherein the cable (2) forms at least one essentially closed loop and is guided at least over a range in an outer sheath (4), the first and second springs (9, 10) for the cable (2) being mounted to outputs (7, 8) of the drive (1) and, while resting against a drive housing (11), act on an end face of the sheath (4).

3. A cable window-lift as defined in claim 1, wherein the cable (2) forms an essentially open loop comprising cable ends of the cable lifting portion (15) and of the cable descending portion (16) acting on the lifter (3), the first and second springs (9, 10) resting against the lifter (3) and acting on the cable ends.

4. A cable window-lift in particular for motor vehicles and evincing a short pane excursion, comprising a drive (1) for the alternating winding and unwinding of a cable (2) running in at least one loop and divided in relation to pane displacement into a cable lifting portion (15) and a cable descending portion (16) and further linked to a lifter (3) moving up and down along a guide (5), a first spring (9) being present in the cable lifting portion (15) and a second spring (10) being present in the cable descending portion (16) to compensate cable slackness, wherein the second spring (10) in the cable descending portion (16), which is loaded during the opening of the pane delivers a spring force larger than the resultant force of the pane weight and the displacement force caused by the friction of the pane being displaced and also larger than the spring force of the first spring (9) mounted in the cable lifting portion (15).

5. A cable window-lift as defined in claim 4, wherein the cable (2) forms at least one essentially closed loop and is guided at least over a range in an outer sheath (4), the first and second springs (9, 10) for the cable (2) being mounted to outputs (7, 8) of the drive (1) and, while resting against a drive housing (11), act on an end face of the sheath (4), each time enclosing the cable (2).

6. A cable window-lift as defined in claim 4, wherein the cable (2) forms an essentially open loop comprising cable ends of the cable lifting portion (15) and of the cable descending portion (16) acting on the lifter (3), the first and second springs (9, 10) resting against the lifter (3) and acting on the cable ends.

7. A cable window lift mechanism for raising and lowering a window pane in a motor vehicle comprising;

a lifter disposed along a guide rail for raising and lowering said window pane;

a cable connected to said lifter;

a drive means for applying tension to said cable in both forward and reverse directions;

a first sheath and a second sheath disposed about said cable, said drive means being interposed between said first sheath and said second sheath;

first and second resilient means for providing respective resilient forces, wherein said first resilient means is disposed between said first sheath and said drive means and said second resilient means disposed between said second sheath and said drive means;

wherein said first resilient means provides a larger resilient force than said second resilient means.

8. A lift mechanism as recited in claim 7, wherein when said drive means applies tension to the cable in said forward direction the lifter is raised, and when said drive means applies tension to said cable in said reverse direction said lifter is lowered.

9. A lift mechanism as recited in claim 8, wherein said first resilient means provides a force larger than a lifting force required to raise said lifter.

10. A lift mechanism as recited in claim 7, wherein said first resilient means provides a resilient force sufficient to ensure that there is no play in said cable when said drive means changes the direction of the tension applied to said cable from said forward direction to said reverse direction.

* * * * *